US009528509B2

(12) United States Patent
Do et al.

(10) Patent No.: US 9,528,509 B2
(45) Date of Patent: Dec. 27, 2016

(54) RECIPROCATING COMPRESSOR CRANKSHAFT ADAPTER AND METHOD

(75) Inventors: Vinh Do, Houston, TX (US); Jeffrey Raynal, Houston, TX (US); Jason Andrew Helton, Oshkosh, WI (US); Carlos Trevino, Houston, TX (US)

(73) Assignee: Nuovo Pignone S.P.A., Florence (IT)

( * ) Notice: Subject to any disclaimer, the term of this patent is extended or adjusted under 35 U.S.C. 154(b) by 0 days.

(21) Appl. No.: 12/872,194

(22) Filed: Aug. 31, 2010

(65) Prior Publication Data

US 2012/0051949 A1 Mar. 1, 2012

(51) Int. Cl.

*F04B 53/18* (2006.01)
*F04B 39/02* (2006.01)
*F04B 27/04* (2006.01)

(52) U.S. Cl.

CPC ..... *F04B 39/0276* (2013.01); *F04B 27/0404* (2013.01); *F04B 39/0284* (2013.01); *Y10T 403/255* (2015.01)

(58) Field of Classification Search

CPC ... F01M 1/02; F01M 2001/0269; F02B 67/04; F02B 27/0404; F02B 27/1036
USPC ..... 184/6.12, 6.28, 6.16; 417/273; 403/37
See application file for complete search history.

(56) References Cited

U.S. PATENT DOCUMENTS 2,427,638 A 9/1947 Vilter et al.
3,685,617 A * 8/1972 Gardner ..... 184/6.28
4,427,309 A * 1/1984 Blake ..... 384/286
4,616,610 A * 10/1986 Ishida ..... 123/196 A
6,192,853 B1 * 2/2001 Natsume ..... 123/196 W
6,698,232 B1 * 3/2004 Duppert et al. ..... 62/470
6,810,849 B1 * 11/2004 Hirsch et al. ..... 123/185.3
7,117,976 B2 * 10/2006 Rowe et al. ..... 184/6.28
7,178,450 B1 * 2/2007 Baker et al. ..... 92/153
7,264,451 B2 * 9/2007 Park ..... 417/417
(Continued)

FOREIGN PATENT DOCUMENTS

CN 2561956 Y 7/2003
JP 55156280 U 11/1980
(Continued)

OTHER PUBLICATIONS

EP Search Report dated Dec. 30, 2011 from corresponding EP Application No. 11178717.2.
(Continued)

*Primary Examiner* — Michael Riegelman
(74) *Attorney, Agent, or Firm* — GE Global Patent Operation

(57) ABSTRACT

Method and device for lubricating a connection. A housing is configured to house a crankshaft adapter that connects an oil pump to a compressor. The housing includes a shell forming a round cavity configured to receive the crankshaft adapter; an oil feed conduit configured to enter through the shell into the round cavity and to deliver oil; a first drain conduit, opposite to the oil feed conduit, and configured to enter through the shell into the round cavity; a plug provided in the first drain conduit; and a second drain conduit configured to enter through the shell into the round cavity. The second drain conduit is located between the oil feed conduit and the first drain conduit, substantially between 50 and 130 degrees relative to the first drain conduit on a periphery of the shell.

20 Claims, 10 Drawing Sheets

(56) References Cited

U.S. PATENT DOCUMENTS

| | | | | |
|---|---|---|---|---|
| 7,806,235 | B1 * | 10/2010 | Roys et al. | 184/6.4 |
| 2008/0169157 | A1 | 7/2008 | Wyker et al. | |

FOREIGN PATENT DOCUMENTS

| | | | |
|---|---|---|---|
| JP | 6135743 | Y2 | 10/1986 |
| JP | 2002188566 | A | 7/2002 |
| SU | 681198 | A1 | 8/1979 |
| SU | 836385 | A1 | 6/1981 |
| SU | 1798537 | A1 | 2/1993 |

OTHER PUBLICATIONS

Unofficial English translation of Chinese Office Action issued in connection with corresponding CN Application No. 201110268801.2 on Dec. 31, 2014.

Russian Notice of Acceptance issued in connection with corresponding RU Application No. 2011135904 on Jun. 11, 2015.

Unofficial English Translation of Japanese Office Action issued in connection with corresponding JP Application No. 2011185516 on Jul. 7, 2015.

* cited by examiner

RECIPROCATING COMPRESSOR CRANKSHAFT ADAPTER AND METHOD

BACKGROUND

Technical Field

Embodiments of the subject matter disclosed herein generally relate to methods and systems and, more particularly, to mechanisms and techniques for distributing oil on a connection.

Discussion of the Background

Gas transmission pipelines, petrochemical plants, refineries and many other industries all depend on a reciprocating compressor. Due to many factors, including but not limited to the quality of the initial specification/design, adequacy of maintenance practices and operational factors, industrial facilities can expect widely varying life cycle costs and reliability from their own installations. One such factor that affects the life cycle of the reciprocating compressor is the oil pump and its connection to the compressor's crankshaft.

FIG. 1 (which corresponds to FIG. 1 of U.S. Patent Application Publication US 2008/0169157 A1, the entire content of which is incorporated herein by reference) shows a compressor 10 including a casing 12. Working pistons 14 are mounted for reciprocating movement within cylinders 16. Each piston is connected to a crankshaft 18 via a connecting rod 20. Connecting rod 20 is secured around offset portion 22 of crankshaft 18. Crankshaft 18 includes counterbalance 24 for balancing the rotational irregularities in the crankshaft. The crankshaft extends through shaft seal cavity 26 of housing 12. End 28 of the crankshaft 18 may be connected to an oil pump (not shown). The oil pump is configured to pump oil to various bearings of the compressor. The oil pump is activated by the rotation of the crankshaft 18. An interface between the crankshaft 18 and a shaft of the oil pump may include a connection adapter. The connection adapter is configured to indirectly receive part of the oil pumped by the oil pump and to lubricate the connection between the oil pump and the compressor.

However, the existing connection adapter is not capable of fully spreading the oil around the connection between the oil pump and the compressor for which reason this method of lubrication is not sufficient and the connection may fail prematurely, thus bringing the entire compressor to a standstill. This outcome is undesirable for the operator of the compressor as the entire processing cycle has to be stopped for fixing the compressor. Alternatively, the compressor itself may fail if the failure of the connection is not observed in time as oil will stop being pumped to the bearings, which will result in a large increase in the temperature of the compressor and subsequent failure.

Accordingly, it would be desirable to provide systems and methods that improve the capabilities of the above discussed systems.

SUMMARY

According to one exemplary embodiment, there is a housing configured to house a crankshaft adapter that connects an oil pump to a compressor. The housing includes a shell forming a round cavity configured to receive the crankshaft adapter; an oil feed conduit configured to enter through the shell into the round cavity and to deliver oil; a first drain conduit, opposite to the oil feed conduit, and configured to enter through the shell into the round cavity and to drain the oil from the round cavity; a plug provided in the first drain conduit to reduce an amount of oil drained away from the round cavity; and a second drain conduit configured to enter through the shell into the round cavity and to drain away oil from the round cavity. The second drain conduit is located between the oil feed conduit and the first drain conduit, substantially between 50 and 130 degrees relative to the first drain conduit.

According to another exemplary embodiment, there is a reciprocating compressor that includes a casing; an oil pump attached to the casing and configured to pump oil through the compressor; a crankshaft adapter that connects the oil pump to the compressor and the crankshaft adapter has at least one fin on an outer periphery; and a housing interposed between the casing and the oil pump and configured to house the crankshaft adapter. The housing includes a shell forming a round cavity configured to receive the crankshaft adapter, an oil feed conduit configured to enter through the shell into the round cavity and to deliver oil, a first drain conduit, opposite to the oil feed conduit, and configured to enter through the shell into the round cavity and to drain the oil from the round cavity, a plug provided in the first drain conduit to reduce an amount of oil drained away from the round cavity, and a second drain conduit configured to enter through the shell into the round cavity and to drain away oil from the round cavity. The second drain conduit is located between the oil feed conduit and the first drain conduit, substantially between 50 and 130 degrees relative to the first drain conduit.

According to still another exemplary embodiment, there is a method for oiling an inside of a housing provided between an oil pump and a compressor. The method includes attaching the housing between the oil pump and the compressor; placing a crankshaft adapter inside a shell of the housing, the shell having a round cavity and the crankshaft adapter having at least one fin on an outer periphery of the crankshaft adapter; establishing an oil feed conduit through the shell to penetrate into the round cavity for delivering oil; forming a first drain conduit, opposite to the oil feed conduit, to enter through the shell into the round cavity and to drain the oil from the round cavity; placing a plug in the first drain conduit to reduce an amount of oil drained away from the round cavity; and establishing a second drain conduit through the shell into the round cavity to drain away oil from the round cavity. The second drain conduit is located between the oil feed conduit and the first drain conduit, substantially between 50 and 130 degrees relative to the first drain conduit.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a reciprocating compressor having an oil pump. However, the embodiments to be discussed next are not limited to these systems, but may be applied to other systems that involve a connection between two rotating elements that needs to be oiled or cooled.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a crankshaft adapter in a compressor is placed in a housing that is configured to receive oil and the crankshaft adapter lubricates an interface between an oil pump and the compressor. The amount of oil leaving the housing is controlled through a cap placed in a drain conduit and also through a drain hole located at a predetermined position in the housing. The crankshaft adapter may have fins for improving the lubrication.

Figure 1:
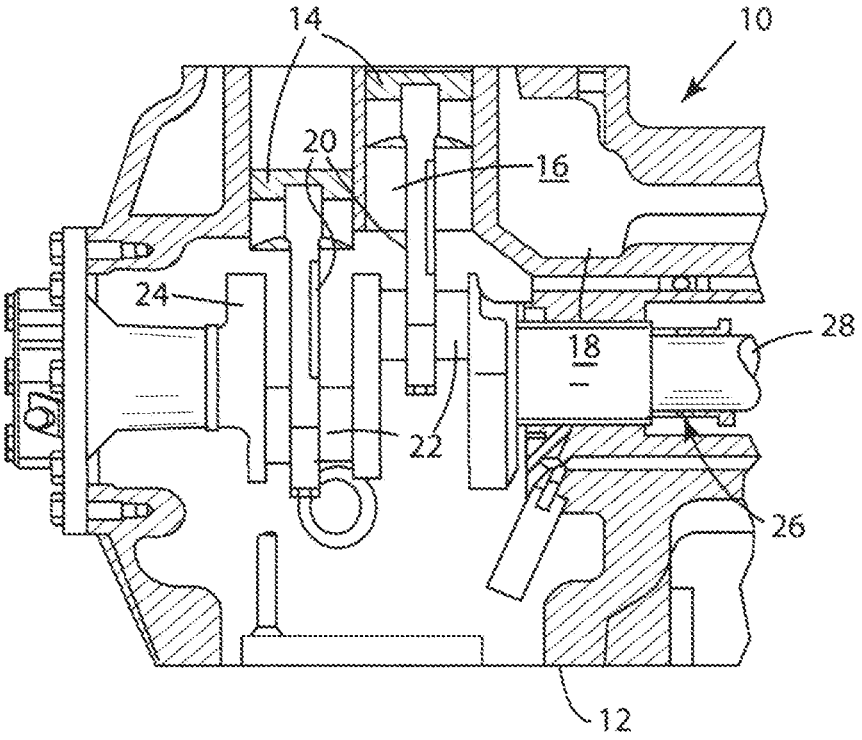
Figure 1 (Background Art)
FIG. 1 is a schematic diagram of a conventional reciprocating compressor.
Figure 2:
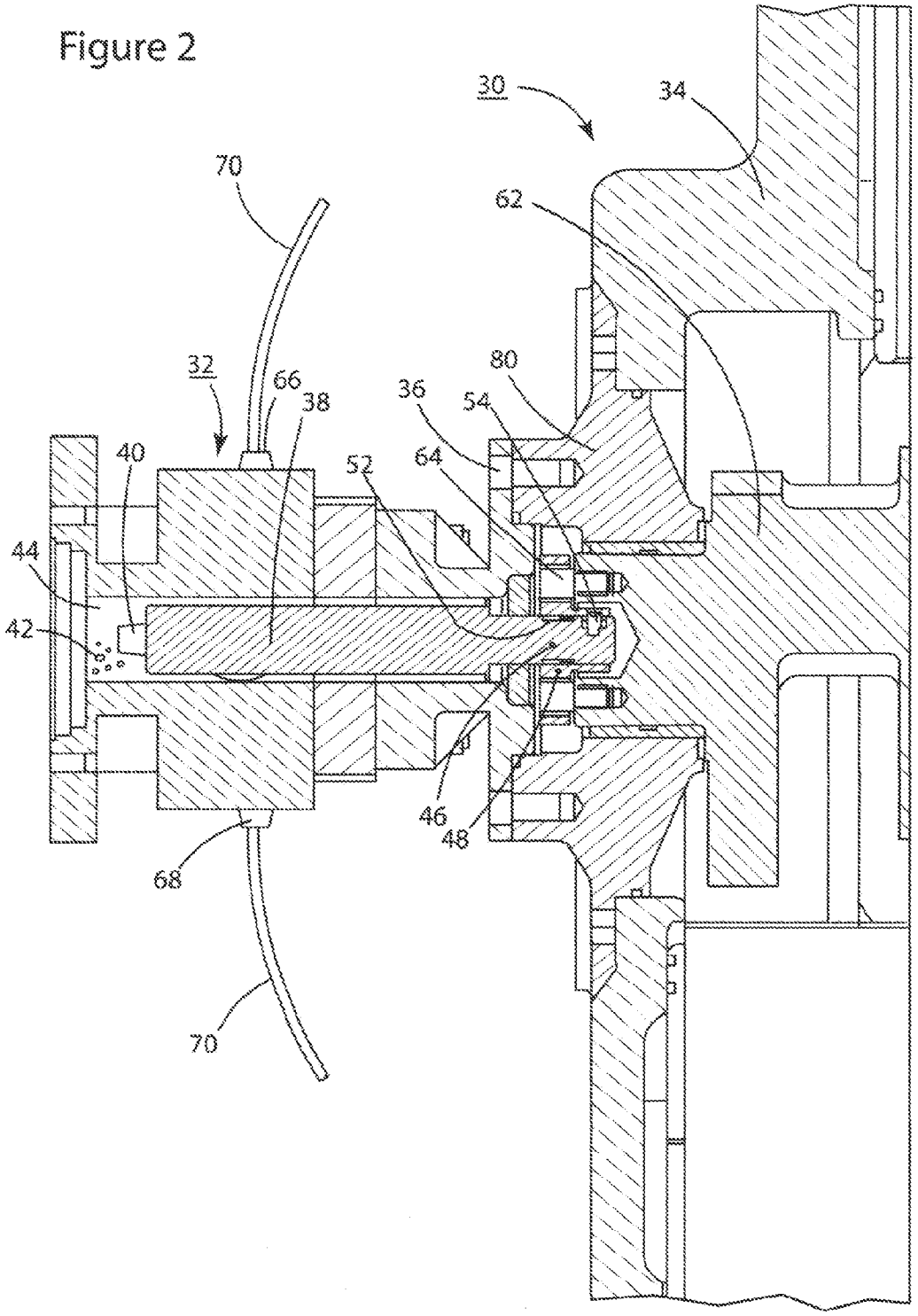
FIG. 2 is a schematic diagram of a reciprocating compressor having a crankshaft adapter according to an exemplary embodiment.

According to an exemplary embodiment, FIG. 2 shows a reciprocating compressor 30 having an oil pump 32. The oil pump 32 is attached to a case 34 of the compressor 30 by, for example, bolts 36. The oil pump 32 has a shaft 38 that is attached to an impeller 40 for pumping oil 42 from a chamber 44 inside the oil pump 32 to various locations (bearings, crankshaft adapter, etc.) in the compressor 30. Shaft 38 has an end 46 that is attached to a crankshaft adapter 48.

Figure 3:
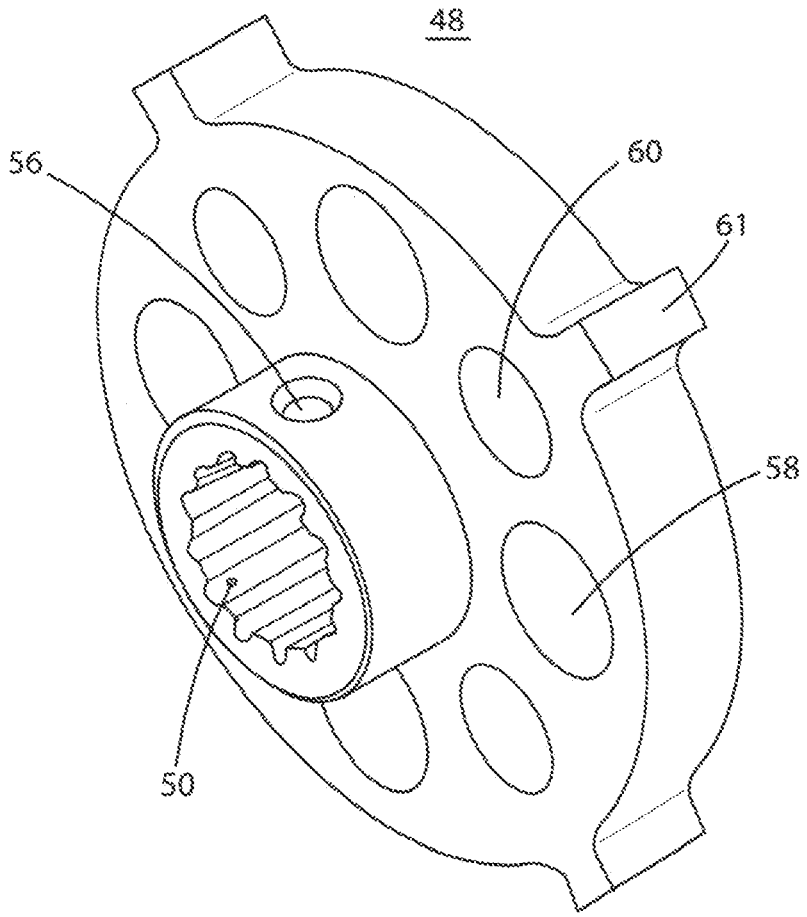
FIG. 3 is a schematic diagram of a crankshaft adapter according to an exemplary embodiment.

An overview of the crankshaft adapter 48 is shown in FIG. 3. According to this exemplary embodiment, the crankshaft adapter 48 has a splined portion 50 that is configured to attach to a corresponding splined portion 52 of the shaft 38. The splined connection may be secured with an appropriate pin 54 (see FIG. 2) that is accommodated by a hole 56 (see FIG. 3) in the crankshaft adapter 48. Other connections between the crankshaft adapter and the shaft of the of the oil pump may be uses, e.g., helical connection, key connection, etc. Crankshaft adapter 48 may have a first set of one or more holes 58 for allowing the oil to pass the adapter and a second set of one or more holes 60. The second set of holes 60 may be used to bolt the crankshaft adapter 48 to a crankshaft 62 of the compressor 30. In this regard, FIG. 2 shows bolts 64 being inserted through holes 60 of the crankshaft adapter 48 and fixed into the crankshaft 62. The crankshaft adapter 48 may have one or more fins (paddles) 61 on an outer periphery for better oil lubrication of the connection. FIG. 3 shows four fins 61. However, the number of fins may be between 1 and 10.

By having the arrangement illustrated in FIG. 2, a rotation of the crankshaft 62 of the compressor 30 determines a rotation of the shaft 38 of the oil pump 32, and thus, the activation of the oil flow through various conduits. For example, FIG. 2 shows an output port 66 and an input port 68 through which the oil is passed back and forth to the compressor. Conduits 70 transport the oil between the oil pump 32 and the compressor 30.

A housing 80 is attached (e.g., bolted) to the casing 34 of the compressor 30 and to the oil pump 32 as shown in FIG. 2. The housing 80 is configured to house the crankshaft adapter 48, the splined end 46 of the shaft 38 and an end of the crankshaft 62 of the compressor 30. In one application, the housing 80 can house only one or two of the above noted elements.

Figure 4:
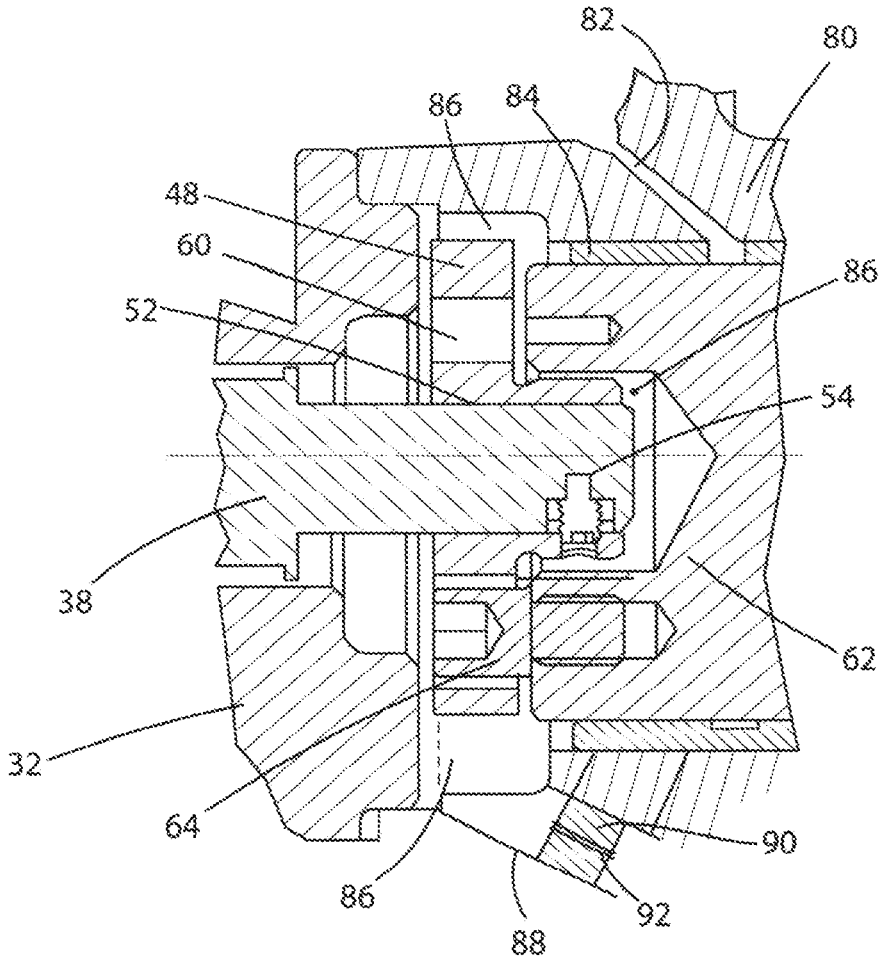
FIG. 4 is a cut through view of an oil pump, crankshaft adapter and reciprocating compressor according to an exemplary embodiment.

FIG. 4 shows in more details the housing 80 and some of the elements inside the housing and in the vicinity of the housing. This figure shows an oil feed conduit 82 that receives oil from the oil pump 32 (e.g., from output port 66) and provides the oil to a bearing 84. Part of the received oil flows in a chamber 86 formed inside the housing 80. In one application, the crankshaft adapter 48 is completely provided inside the chamber 86 of the housing 80.

A drain conduit 88 formed in the housing 80 has a predetermined internal diameter. However, this predetermined internal diameter (which is dictated by a combination of factors, e.g., manufacturer, capacity of oil pump, type of oil, etc.) is too large for maintaining a desired amount of oil inside chamber 86. Not having enough oil in chamber 86, the lubrication performed by the crankshaft adapter 48 is diminished, which may result in an early failure of the splined connection. A plug 90 may be provided inside the drain conduit 88 for limiting the amount of oil that drains from chamber 86. In this way, an amount of oil present in the chamber 86 is increased. However, there are times when the compressor is not in use and thus, it is desirable to allow the oil in chamber 86 to drain away. Thus, in one exemplary embodiment, the plug 90 may have a weep hole (channel) 92 that allows the oil to drain when the compressor is not in use. It is noted that the weep hole 92 is optional and the inside diameter of the weep hole depends on the size of the chamber 86, the type of oil, the manufacturer, etc.

Figure 5:
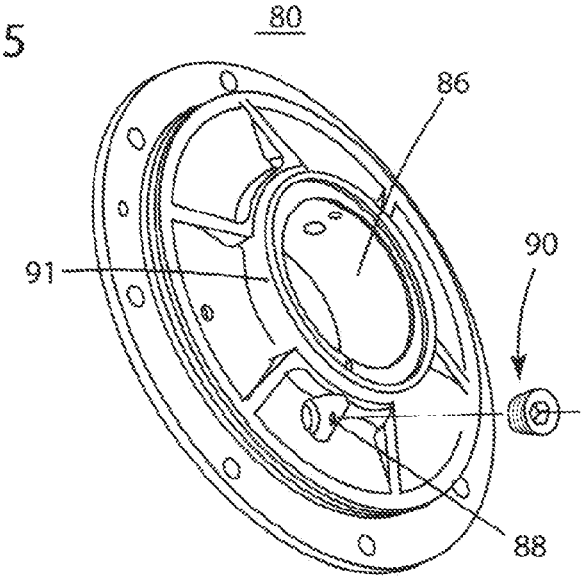
FIG. 5 is a side view of a housing between an oil pump and reciprocating compressor according to an exemplary embodiment.

According to an exemplary embodiment, FIG. 5 is an overview of housing 80 having the plug 90 provided in the drain conduit 88. It is noted in this figure a shell 91 made of metal and configured to define part of the chamber 86.

Figure 6:
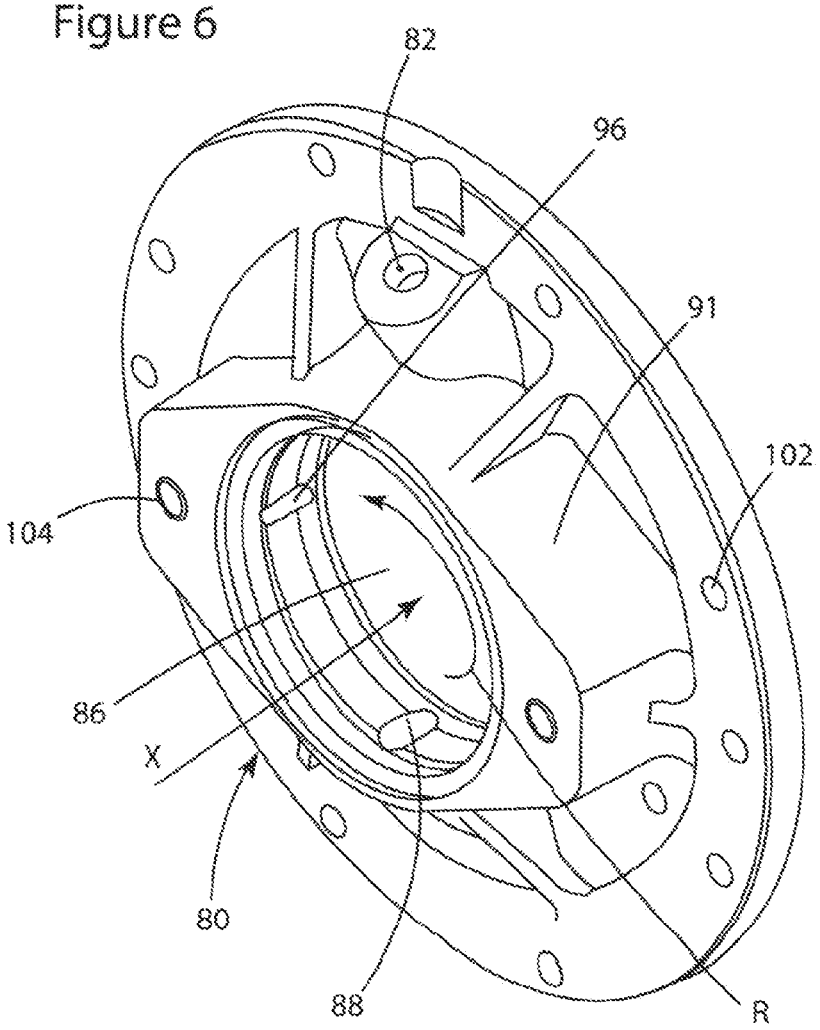
FIG. 6 is another side view of a housing between an oil pump and reciprocating compressor according to an exemplary embodiment.
Figure 7:
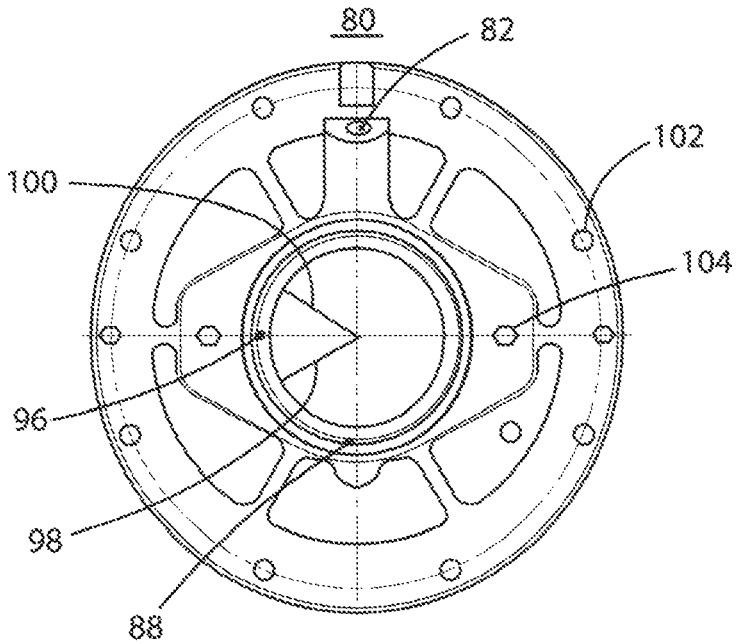
FIG. 7 is a top view of a housing between an oil pump and reciprocating compressor according to an exemplary embodiment.

According to another exemplary embodiment shown in FIG. 6, housing 80 has an additional drain hole (or conduit) 96 disposed on a side of the housing, at a predetermined height relative to the first drain conduit 88. The predetermined height is better illustrated by considering FIG. 7, which shows a top view of the housing 80 (from the oil pump). FIG. 7 shows that the second drain hole 96 is provided substantially at 90 degrees relative to the first drain conduit 88. However, in another exemplary embodiment, the second drain hole 96 is provided between 50 degrees and 130 degrees relative to the first drain conduit 88, as illustrated by lines 98 and 100. The second drain hole 96 is such dimensioned that any oil that overflows from chamber 86 is handled in a timely manner (e.g., drained out of the chamber 86).

Still with regard to FIG. 6, it is noted that the location of the second drain hole 96 to the first drain conduit is about 9 o'clock when viewing the housing 80 along axis X. However, this position is dependent on the rotational direction of the crankshaft adapter 48. In FIG. 6 it is assumed that the crankshaft adapter 48 rotates as indicated by arrow R. However, if the rotational motion of the crankshaft adapter 48 is reversed, then the location of the second drain hole 96 is moved to be around 3 o'clock (between 2 and 4 o'clock). One reason for this correlation is to not force the oil too quickly out of the chamber 86 through the second drain hole 96 when the crankshaft adapter 48 rotates.

The actual dimension of the drain hole 96 depends from compressor to compressor but is noted that the drain hole 96 should handle a rotation of the crankshaft of, for example, 1800 rpm, and a pressure of the oil of around 50 psi. FIG. 7 also shows various holes 102 formed in a flange region of the housing 80 and these holes accommodate bolts that bolt the housing 80 to the compressor 30. Further, the housing 80 has additional holes 104 (also shown in FIG. 6) for attaching the housing to the oil pump 32.

Figure 8:
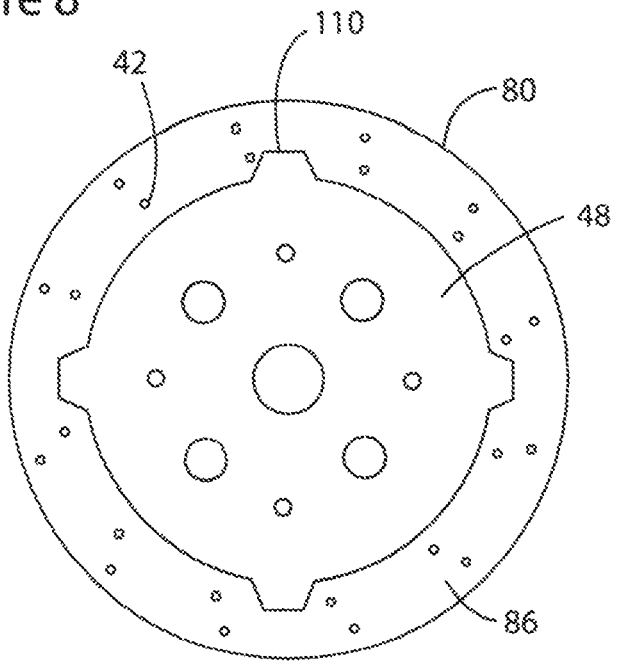
FIG. 8 is a schematic diagram of oil splashed by a crankshaft adapter according to an exemplary embodiment.
Figure 10:
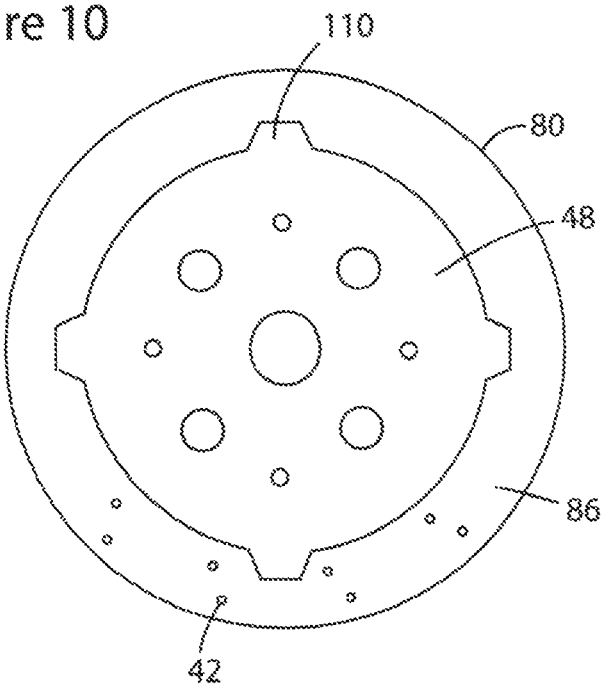
FIG. 10 is a schematic diagram of oil splashed by a traditional crankshaft adapter.
Figure 9:
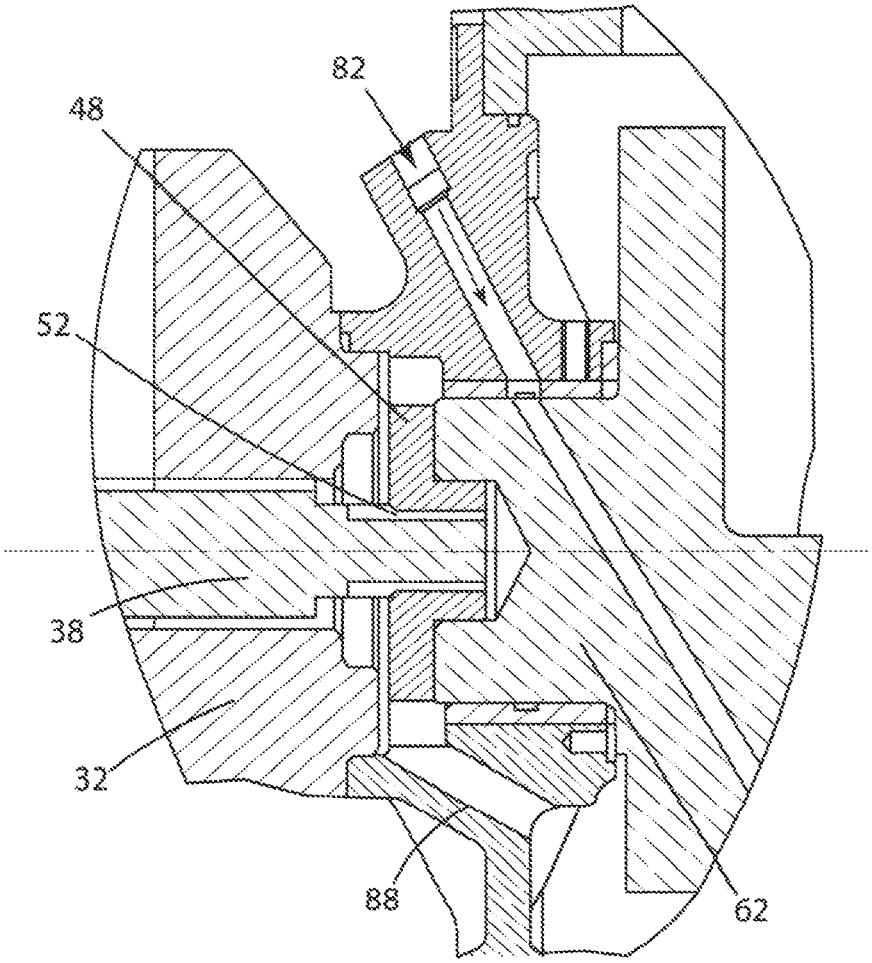
FIG. 9 is a cut through of a reciprocating compressor.

Because of the reduced drainage through drain conduit 88, the overflow drainage provided by hole 96, and the fins of the crankshaft adapter, a better oil distribution in the housing 86, around the crankshaft adapter 48, is obtained. A test performed on a reciprocating compressor having a splined oil pump and a crankshaft adapter as shown in FIGS. 2-7 indicates that oil 42 is splashed almost uniformly as shown in FIG. 8. On the contrary, when the same test is performed on the same compressor but without plug 90, second drain hole 96, and fins 61 as shown in FIG. 9, the test indicates that the oil 42 is being splashed only at a bottom portion of the crankshaft adapter 48 as shown in FIG. 10. Crankshaft adapter 48 may have four fins 110 as shown in FIG. 8 for more efficiently splashing the oil 42.

Figure 12:
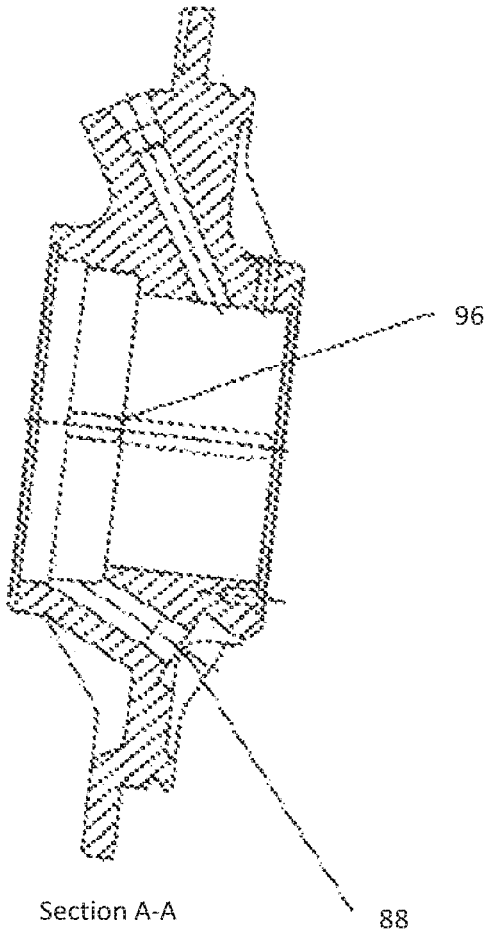
FIG. 12 shows a cut through view A-A of the housing according to an exemplary embodiment.

The oil being drained from the second drain hole 96 follows a path that intersects the first-drain conduit 88 after plug 90. With reference to FIG. 12, the first drain conduit 88 can be seen above the second drain hole 96 such that the overflow from the second drain conduit 88 intersects the flow path of the first drain conduit 88.

Figure 11:
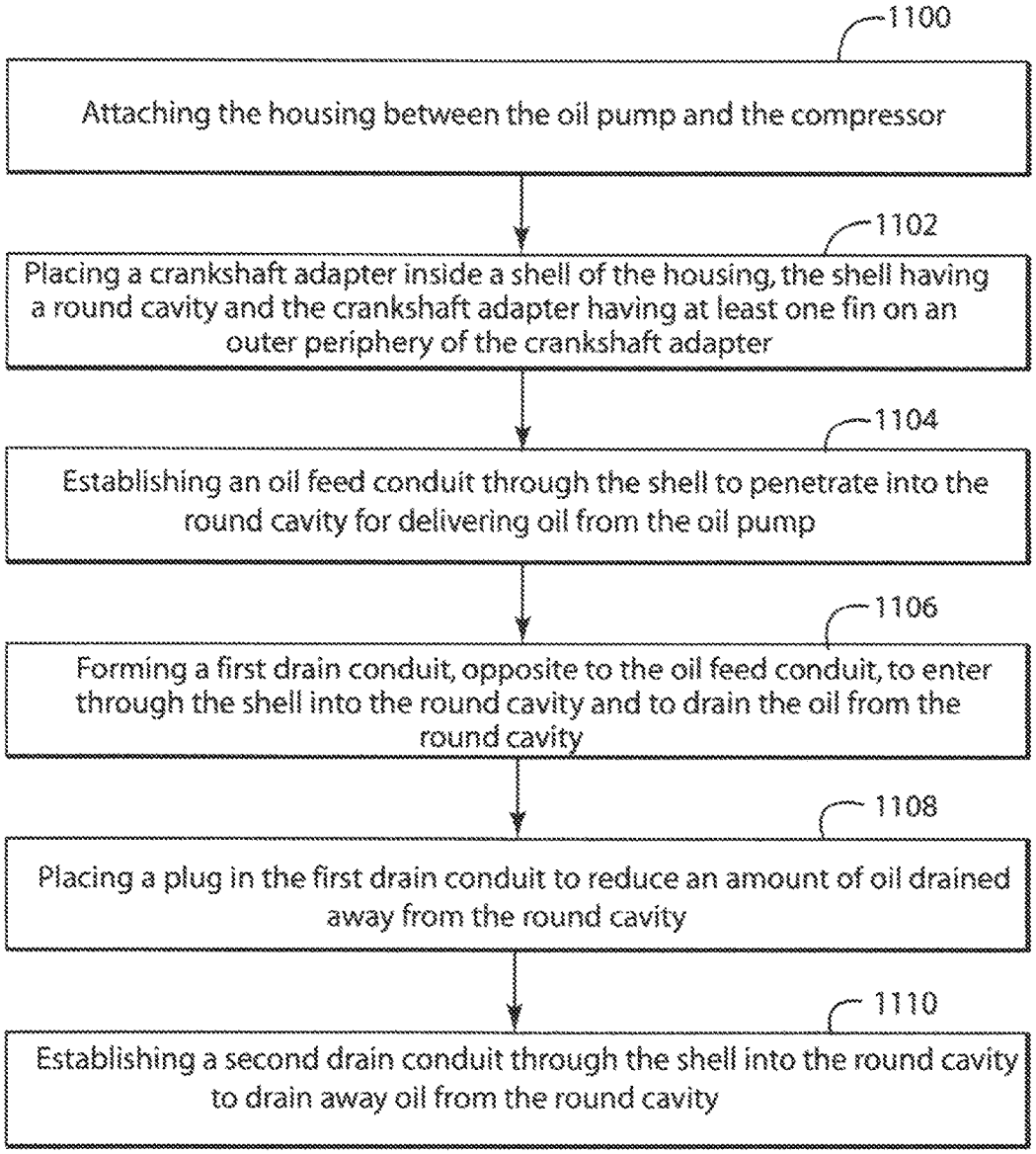
FIG. 11 is a flow chart illustrating a method for lubricating a connection according to an exemplary embodiment.

According to an exemplary embodiment illustrated in FIG. 11, there is a method for oiling an inside of a housing provided between an oil pump and a compressor. The method includes a step 1100 of attaching the housing between the oil pump and the compressor; a step 1102 of placing a crankshaft adapter inside a shell of the housing, the shell having a round cavity and the crankshaft adapter having at least one fin on an outer periphery of the crankshaft adapter; a step 1104 of establishing an oil feed conduit through the shell to penetrate into the round cavity for delivering oil from the oil pump; a step 1106 of forming a first drain conduit, opposite to the oil feed conduit, to enter through the shell into the round cavity and to drain the oil from the round cavity; a step 1108 of placing a plug in the first drain conduit to reduce an amount of oil drained away from the round cavity; and a step 1110 of establishing a second drain conduit through the shell into the round cavity to drain away oil from the round cavity. The second drain conduit is located between the oil feed conduit and the first drain conduit, substantially between 50 and 130 degrees relative to the first drain conduit.

The disclosed exemplary embodiments provide a system and a method for lubricating a connection between an oil pump and a compressor. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A housing configured to house a crankshaft adapter that connects an oil pump to a compressor, the housing comprising:

a shell forming a round cavity configured to receive the crankshaft adapter;

an oil feed conduit positioned on a periphery of the housing configured to facilitate oil flow through the shell into the round cavity;

a first drain conduit disposed through the shell and into the round cavity opposite the oil feed conduit and configured to facilitate draining oil from the round cavity;

a plug configured for placement in the first drain conduit to reduce an amount of the oil drained from the round cavity; and a second drain conduit formed through the shell into the round cavity, and configured to facilitate draining the oil from the round cavity and into the first drain conduit after the plug;

wherein the second drain conduit is positioned on a periphery of the shell between the oil feed conduit and the first drain conduit, in a position between 50 degrees and 130 degrees relative to an axial line between the first drain conduit and the oil feed conduit, and wherein the second drain conduit is configured such that overflows of oil from the round cavity not drained through the first drain conduit are drained out of the round cavity.

2. The housing of claim 1, wherein the plug has a conduit configured to allow oil to drain from the round cavity, an inner diameter of the conduit of the plug being smaller than an inner diameter of the second drain conduit.

3. The housing of claim 1, further comprising:

a first set of holes configured to be attached to the compressor; and a second set of holes configured to be attached to the oil pump, wherein both the first set of holes and the second set of holes are located on the housing, which is one piece.

4. The housing of claim 1, further comprising:
the compressor;
the oil pump; and
the crankshaft adapter having at least one fin on an outer periphery,
wherein the housing is bolted between the compressor and the oil pump and the crankshaft adapter is configured to connect to a shaft of the oil pump and a crankshaft of the compressor.

5. The housing of claim 4, wherein the compressor is a reciprocating compressor and when the crankshaft adapter rotates clockwise, the second drain conduit is located counterclockwise between the first drain conduit and the oil feed conduit and when the crankshaft adapter rotates counterclockwise, the second drain conduit is located clockwise between the first drain conduit and the oil feed conduit.

6. The housing of claim 4, wherein a connection between the shaft of the oil pump and the crankshaft adapter is a splined connection.

7. The housing of claim 6, wherein the crankshaft adapter is bolted to the crankshaft of the compressor.

8. The housing of claim 4, further comprising:
a bearing configured to support the crankshaft of the compressor.

9. A reciprocating compressor comprising:
a casing;
an oil pump attached to the casing and configured to pump oil through the compressor;
a crankshaft adapter that connects the oil pump to the compressor and the crankshaft adapter has at least one fin on an outer periphery; and
a housing interposed between the casing and the oil pump and configured to house the crankshaft adapter, the housing comprising,
a shell forming a round cavity configured to receive the crankshaft adapter;
an oil feed conduit position on a periphery of the housing configured to facilitate oil flow through the shell into the round cavity;
a first drain conduit disposed through the shell and into the round cavity opposite the oil feed conduit and configured to facilitate draining oil from the round cavity;
a plug configured for placement in the first drain conduit to reduce an amount of the oil drained from the round cavity; and
a second drain conduit formed through the shell into the round cavity, and configured to facilitate draining the oil from the round cavity and into the first drain conduit after the plug;
wherein the second drain conduit is positioned on a periphery of the shell between the oil feed conduit and the first drain conduit, in a position between 50 degrees and 130 degrees relative to an axial line between the first drain conduit and the oil feed conduit and wherein the second drain conduit is configured such that overflows of oil from the round cavity not drained through the first drain conduit are drained out of the round cavity.

10. The reciprocating compressor of claim 9, wherein the plug has a conduit configured to allow oil to drain from the round cavity, an inner diameter of the conduit of the plug being smaller than an inner diameter of the second drain conduit.

11. The reciprocating compressor of claim 9, wherein the housing is bolted between the compressor and the oil pump and the crankshaft is configured to connect to a shaft of the oil pump and a crankshaft of the compressor.

12. The reciprocating compressor of claim 11, wherein when the crankshaft adapter rotates clockwise, the second drain conduit is located counterclockwise between the first drain conduit and the oil feed conduit and when the crankshaft adapter rotates counterclockwise, the second drain conduit is located clockwise between the first drain conduit and the oil feed conduit.

13. The reciprocating compressor of claim 11, wherein a connection between the shaft of the oil pump and the crankshaft adapter is a splined connection.

14. The reciprocating compressor of claim 9, further comprising:
a bearing provided inside the housing and configured to support a crankshaft of the compressor.

15. The reciprocating compressor of claim 9, further comprising:
a first conduit configured to fluidly communicate an output port of the oil pump with the oil feed conduit of the compressor; and
a second conduit configured to fluidly communicate an input port of the oil pump with the first and second drain conduits of the compressor.

16. A method for oiling an inside of a housing provided between an oil pump and a compressor, the method comprising:
attaching the housing between the oil pump and the compressor;
placing a crankshaft adapter inside a shell of the housing, the shell having a round cavity and the crankshaft adapter having at least one fin on an outer periphery of the crankshaft adapter;
establishing an oil feed conduit positioned on a periphery of the housing to facilitate oil flow through the shell to penetrate into the round cavity;
forming a first drain conduit through the shell and into the round cavity opposite the oil feed conduit and configured to facilitate draining the oil from the round cavity;
placing a plug in the first drain conduit to reduce the an amount of oil drained from the round cavity; and
establishing a second drain conduit formed through the shell into the round cavity, and configured to facilitate draining the oil from the round cavity and into the first drain conduit after the plug, wherein the second drain conduit is positioned on a periphery of the shell between the oil feed conduit and the first drain conduit, in a position between 50 degrees and 130 degrees relative to an axial line between the first drain conduit and the oil feed conduit and wherein the second drain conduit is configured such that overflows of oil from the round cavity not drained through the first drain conduit are drained out of the round cavity.

17. The method of claim 16, further comprising:
forming a conduit in the plug to allow oil to drain from the round cavity, an inner diameter of the conduit of the plug being smaller than an inner diameter of the second conduit.

18. The method of claim 16, further comprising:
connecting the crankshaft adapter to a shaft of the oil pump and to a crankshaft of the compressor.

19. The method of claim 16, further comprising:
establishing a flowing path from an output port of the oil pump to the housing, the round cavity, the first and second drain conduits, and back to an input port of the oil pump.

20. The method of claim 16, further comprising:

providing a splined connection between a shaft of the oil pump and the crankshaft of the compressor.

* * * * *